US008827724B2

(12) United States Patent
Takeuchi et al.

(10) Patent No.: US 8,827,724 B2
(45) Date of Patent: Sep. 9, 2014

(54) BOARD CONNECTOR

(75) Inventors: Ryotaro Takeuchi, Yamato (JP); Koji Yamane, Yamato (JP)

(73) Assignee: Molex Incorporated, Lisle, IL (US)

( * ) Notice: Subject to any disclaimer, the term of this patent is extended or adjusted under 35 U.S.C. 154(b) by 157 days.

(21) Appl. No.: 13/003,129

(22) PCT Filed: Jul. 7, 2009

(86) PCT No.: PCT/US2009/049791

§ 371 (c)(1),
(2), (4) Date: Jan. 7, 2011

(87) PCT Pub. No.: WO2010/005956

PCT Pub. Date: Jan. 14, 2010

(65) Prior Publication Data

US 2011/0111648 A1 May 12, 2011

(30) Foreign Application Priority Data

Jul. 7, 2008 (JP) ..... 2008-176605

(51) Int. Cl.

| | |
|---|---|
| ***H01R 12/00*** | (2006.01) |
| ***H01R 13/631*** | (2006.01) |
| ***H01R 12/71*** | (2011.01) |
| *H01R 12/57* | (2011.01) |
| *H01R 13/20* | (2006.01) |

(52) U.S. Cl.

CPC ..... *H01R 13/6315* (2013.01); *H01R 12/716* (2013.01); *H01R 12/57* (2013.01); *H01R 13/20* (2013.01)

USPC ..... 439/74

(58) Field of Classification Search

CPC .... H01R 12/716; H01R 12/718; H01R 12/52; H01R 12/57; H01R 12/714; H01R 12/79; H01R 13/193; H01R 13/2407; H01R 13/2442

USPC ..... 439/74, 81, 660

See application file for complete search history.

(56) References Cited

U.S. PATENT DOCUMENTS 5,975,916 A * 11/1999 Okura ..... 439/74
6,827,588 B1 * 12/2004 Huang et al. ..... 439/74

(Continued)

FOREIGN PATENT DOCUMENTS

EP 1 548 800 A1 6/2005
JP 02-049373 2/1990

(Continued)

OTHER PUBLICATIONS

International Search Report for PCT/US2009/049791.

*Primary Examiner* — Xuong Chung Trans
(74) *Attorney, Agent, or Firm* — Timothy M. Morella

(57) ABSTRACT

The board connector (1) comprises a first connector, including a first housing (11) capable of accommodating the first terminals (61), and a second connector (101) which is configured to be fitted to the first connector (1) and including a second housing (111) capable of accommodating the second terminals (161). Both terminals (61, 161) are configured to come into contact with each other at first contact points (71) and second contact points (72), respectively. Each first terminal is capable of showing a high flexibility and each of the second terminals is showing a high rigidity at either one of the first contact point and the second contact point. Further, each first terminals is capable of showing a high rigidity and each second terminals is capable of showing a high flexibility at different either one of the first contact point and the second contact point.

16 Claims, 11 Drawing Sheets

(56) References Cited

U.S. PATENT DOCUMENTS

| | | | | |
|---|---|---|---|---|
| 7,384,274 | B1 * | 6/2008 | Chen et al. | 439/74 |
| 7,568,919 | B2 * | 8/2009 | Hoshino et al. | 439/74 |
| 7,736,177 | B2 * | 6/2010 | Tsai | 439/570 |
| 7,744,377 | B2 * | 6/2010 | Wu et al. | 439/74 |
| 7,748,993 | B2 * | 7/2010 | Midorikawa et al. | 439/74 |
| 8,083,527 | B2 * | 12/2011 | Takeuchi et al. | 439/65 |
| 2007/0264854 | A1 | 11/2007 | Sasaki | |
| 2007/0275575 | A1 * | 11/2007 | Wang | 439/74 |

FOREIGN PATENT DOCUMENTS

| | | | |
|---|---|---|---|
| JP | 2000-331731 | | 11/2000 |
| JP | 2003-163054 | A | 6/2003 |
| JP | 2005-108581 | | 4/2005 |
| JP | 2006-269418 | | 10/2006 |
| JP | 2007-328946 | | 12/2007 |
| WO | WO 98/09354 | A1 | 3/1998 |
| WO | WO 2008/016329 | A1 | 2/2008 |

* cited by examiner

Prior Art

BOARD CONNECTOR

BACKGROUND OF THE INVENTION

1. Field of the Invention

The Present Invention relates, generally, to a board connector, and, more particularly, to a board connector in which a first terminal has high flexibility and rigidity, and a second terminal has a high rigidity at a first contact point and a high flexibility at a second contact point.

2. Description of the Related Art

Conventionally, board connectors are used to electrically connect two or more devices together, such as printed circuit boards to each other or an electric cable to a printed circuit board. Such types of board connectors are mounted on the surface of a printed circuit board and provided with a connector part which projects from that surface. An example of such a type of a board connector is found in Japanese Patent Application Nos. 2000-331731 and 2006-269418.

Further, FIGS. 11A-B illustrate cross-sectional views of a conventional board connector; with FIG. 11A illustrating a state before fitting and FIG. 11B after fitting. Referring to the Figures, receptacle connector 801 is mounted on a first circuit board (not illustrated), and plug connector 901 mounted on a second circuit board (not illustrated). Receptacle connector 801 has receptacle terminals 861 loaded in receptacle housing 811, which is made from an insulating material. Plug connector 901 has plug terminals 961*a*, 961*b* loaded in plug housing 911, also made from an insulating material. Further, receptacle housing 811 has a protruding portion 812 thereof, and plug housing 911 has protruding portions 912 thereof.

As receptacle connector 801 and plug connector 901 are fitted together, as illustrated in FIG. 11B, preferably by connecting receptacle terminals 861 and plug terminals 961*a*, 961*b*, the first and second circuit boards are electrically connected. In this case, as receptacle terminals 861 and plug terminals 961*a*, 961*b* come into contact with each other at two points, first contact point 865*a*, second contact point 865*b*, receptacle terminals 861 and plug terminals 961*a*, 961*b* come into multipoint contact with each other, which maintains the contact state thereof without fail. Moreover, the multipoint contact increases the removal force necessary to remove plug connector 901 from receptacle connector 801. Therefore, the fitted state of receptacle connector 801 and plug connector 901 is maintained with certainty.

However, in the conventional board connector, misalignment may occur between the fitting axes of receptacle connector 801 and plug connector 901 after either component is subjected to a great impact, possibly due to falling and so forth. In such a case, second contact point 865*b* may be unable to follow the misalignment and as a result, the contact may be interrupted. As evident from the structure shown in FIGS. 11A-B, flexibility of plug terminal 961*a* might be low, but that of receptacle terminal 861 is high at first contact point 865*a*, whereas both plug terminal 961*b* and receptacle terminal 861 have a high rigidity, respectively, at second contact point 865*b* and thus, a low flexibility must be shown at the same point. Therefore, second contact point 865*b* is often unable to compensate for misalignment that appears between the fitting axes of receptacle connector 801 and plug connector 901.

Nevertheless, since both plug terminal 961*b* and receptacle terminal 861 have a high rigidity at second contact point 865*b*, the removal force becomes larger, thus ensuring that the fitted state between receptacle connector 801 and plug connector 901 are maintained. At the same time, however, an insertion force which is necessary to insert plug connector 901 into receptacle connector 801 increases as well. Therefore, fitting workability for fitting receptacle connector 801 and plug connector 901 is degraded.

SUMMARY OF THE INVENTION

It is an object of the Present Invention to solve the problems encountered by the conventional board connector, and to provide a board connector in which each first terminal has a high flexibility and each second terminal has a high rigidity at a first contact point, and each of the first terminals has a high rigidity and each of the second terminals has a high flexibility at a second contact point, so that contact states at the first contact point and the second contact point can be maintained without fail even when an external force is applied thereto, an occurrence of any instantaneous disconnection is prevented, both small insertion force and large removal force are realized, thereby increasing operability and reliability of the board connector.

Therefore, the board connector of the Present Invention comprises a first connector, which includes first terminals and a first housing capable of accommodating the first terminals, and a second connector which is configured to be fitted to the first connector and to includes second terminals and a second housing capable of accommodating the second terminals. The first terminals and the second terminals are configured to come into contact with each other at first contact points and second contact points, respectively. Each first terminal is capable of showing a high flexibility and each of the second terminals is capable of showing a high rigidity at either one of the first contact point and the second contact point. Further, each first terminals is capable of showing a high rigidity and each second terminals is capable of showing a high flexibility at different either one of the first contact point and the second contact point.

According to another embodiment, there is provided the board connector, in which the terminals showing the high flexibility at the first contact points have a natural frequency thereof, which differs from that of the terminals showing the high flexibility at the second contact points.

According to a further embodiment, there is provided the board connector, in which each first terminal is provided with a first contact portion having a high flexibility and a second contact portion having a high rigidity, and each second terminal is provided with a first contact portion having the high rigidity and a second contact portion having the high flexibility. The first contact portions come into contact with each other at the first contact point, and the second contact portions come into contact with each other at the second contact point.

According to a still further embodiment, there is provided the board connector, in which each first terminal includes a held portion thereof held by the first housing. The second contact portion is configured to be connected to the held portion and have a distal end thereof projecting into each recessed groove portion of the first housing. The first contact portion is configured to be connected to the second contact portion via a U letter-shaped connecting portion, and have a distal end thereof projecting into each of the recessed groove portions of the first housing while facing the second contact portion. Each second terminal includes a held portion thereof held by the second housing. The first contact portion is configured to be connected to the held portion and in contact with one of side walls of each protruding portion of the second housing. The second contact portion has a cantilever-shape, and one end thereof connected to the first contact portion and the other end thereof distant apart from the other side wall of each of the protruding portions. Each second terminal comes to a position where said each second terminal is sandwiched between the contact portions and of the first terminal when the protruding portions are inserted into the recessed groove portions.

In the board connector, each first terminal has a high flexibility and each second terminal has a high rigidity at the first contact point, and each first terminal has a high rigidity and each second terminal has a high flexibility at the second contact point. Therefore, even when an external force is applied to the board connector, the contact states at the first and second contact points are constantly maintained without fail, and an occurrence of any instantaneous disconnection is prevented, thus making the board connector highly reliable in the performance thereof. Moreover, both small insertion force and large removal force are realized, thereby increasing operability of the board connector.

BRIEF DESCRIPTION OF THE FIGURES

The organization and manner of the structure and operation of the Present Invention, together with further objects and advantages thereof, may best be understood by reference to the following Detailed Description, taken in connection with the accompanying Figures, wherein like reference numerals identify like elements, and in which:

FIGS. 11A-11B are cross-sectional views of a conventional board connector, in which FIG. 11A shows a state before fitting and FIG. 11B shows a state after fitting.

DESCRIPTION OF THE PREFERRED EMBODIMENTS

Figure 1:
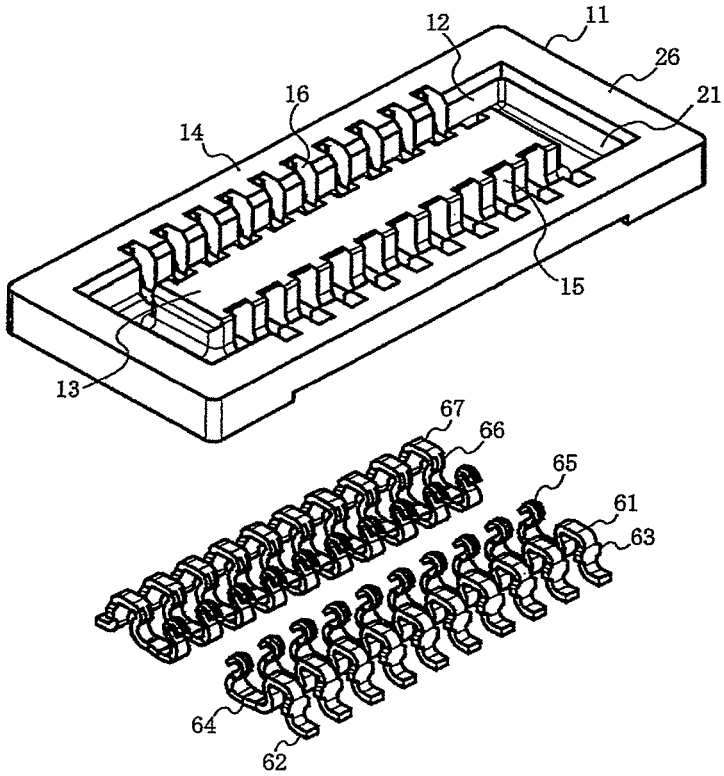
FIG. 1 is an exploded view of a first connector according to an embodiment of the Present Invention.
Figure 2:
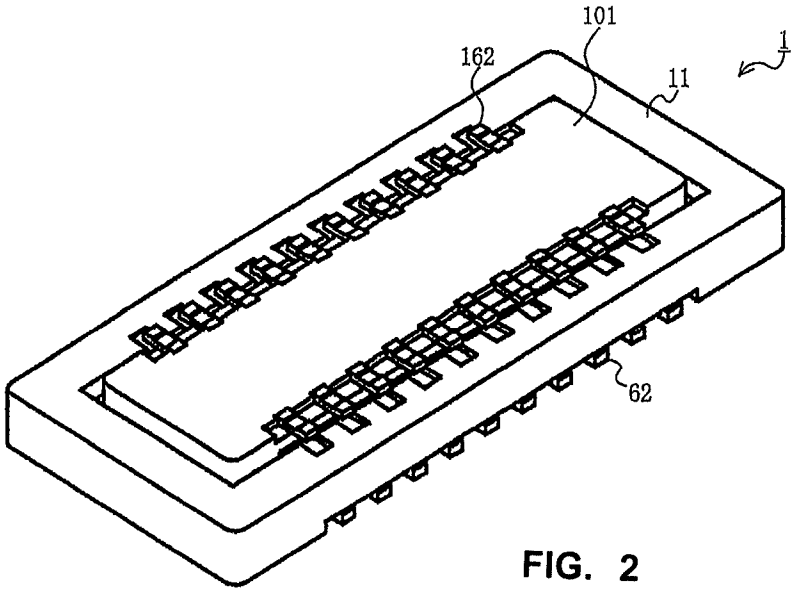
FIG. 2 is a perspective view observed from a fitting surface side of the first connector of FIG. 1, and showing a state where the first connector and a second connector are fitted together.
Figure 3:
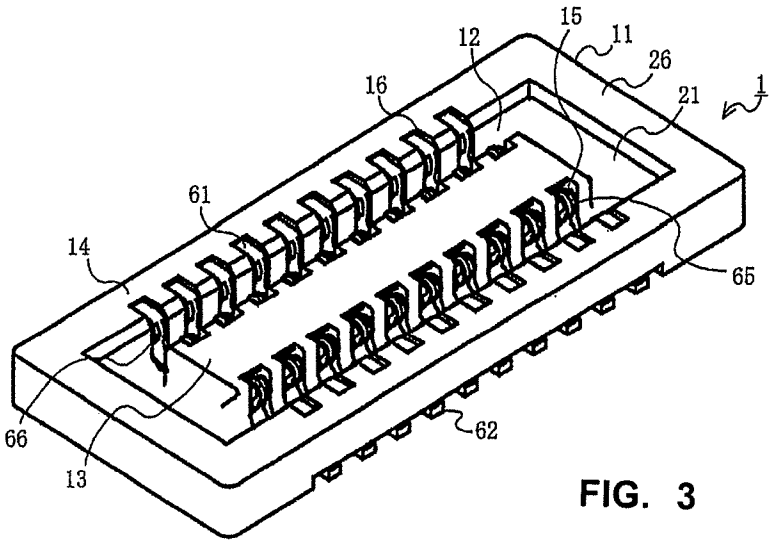
FIG. 3 is a perspective view of the first connector of FIG. 1, observed from the fitting surface side thereof.
Figure 4:
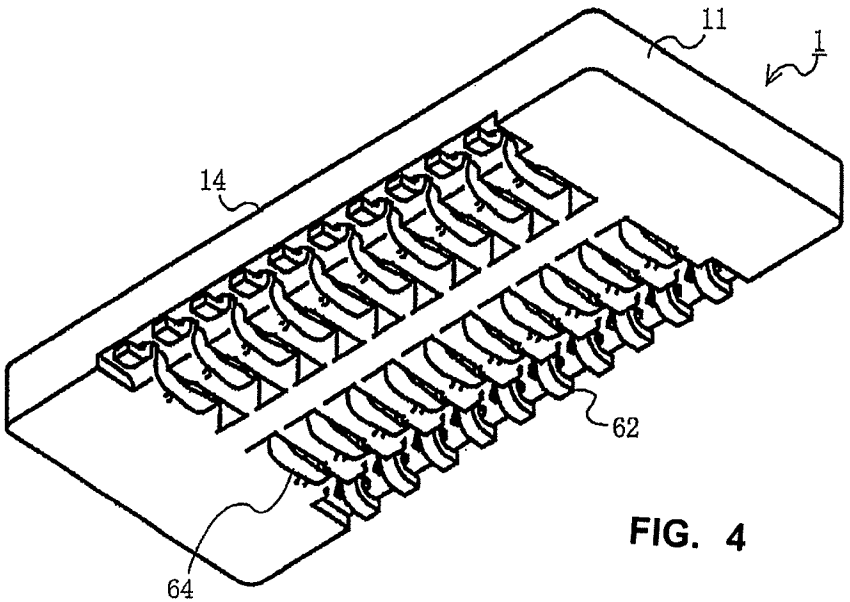
FIG. 4 is a perspective view of the first connector of FIG. 1, observed from a mounting surface side thereof.

While the Present Invention may be susceptible to embodiment in different forms, there is shown in the Figures, and will be described herein in detail, specific embodiments, with the understanding that the discussion herein is to be considered an exemplification of the principles of the Present Invention, and is not intended to limit the Present Invention merely to that as illustrated. Further, in the embodiments illustrated in the Figures, representations of directions such as up, down, left, right, front, rear and the like, used for explaining the structure and movement of the various elements of the Present Invention, are not absolute, but relative. These representations are appropriate when the elements are in the position shown in the Figures. If the description of the position of the elements changes, however, it is assumed that these representations are to be changed accordingly.

Referring to FIGS. 1-4, first connector 1, preferably capable of operating as one of a pair of board connectors, is a surface mountable connector mounted on a surface of first board 91. Further, second connector 101, which can operate as the other connector of the pair of board connectors, is also a surface mountable connector mounted on a surface of second board 191. The board connector of the Present Invention includes first connector 1 and second connector 101, which electrically connects first board 91 and second board 191 to each other. First board 91 and second board 191 may be, for example, printed circuit boards used in electronic devices, but may be any type of boards. Further, second connector 101 may be connected to ends of a plurality of electric cables instead of second board 191.

First connector 1 includes first housing 11 integrally formed of an insulating material. As illustrated, first housing 11 has an approximate rectangular, parallelepiped, thick plate-like shape. An approximately rectangular-enclosed recessed portion is formed in a surface on a side to which second connector 101 is fitted. First connector 1 has dimensions of, for example, approximately 7.0 mm in length, approximately 2.5 mm in width and approximately 1.0 mm in thickness, although these dimensions may be varied.

Protruding portion 13 is formed in the recessed portion integrally with first housing 11. Side wall portions 14, extending in parallel with protruding portion 13 on both sides of protruding portion 13, are also formed integrally with first housing 11. Protruding and side wall portions 13, 14 upwardly project from a surface of the recessed portion and extend in the longitudinal direction of first housing 11. On both sides of protruding portion 13, recessed groove portions 12 are formed between protruding portion 13 and side wall portions 14 as long, thin, insertion recessed portions which extend in the longitudinal direction of first housing 11. In the Figures, there is illustrated one protruding portion 13; this, however, may vary, as required. Protruding portion 13 has a preferred dimension of, for example, approximately 0.6 mm.

Recessed groove-shaped first terminal accommodating cavities 15 are formed to accommodate first terminals 61, disposed to laterally straddle the side surfaces of protruding portion 13 and the bottom surfaces of recessed groove portions 12. As illustrated, there are Ten (10) first terminal accommodating cavities 15, formed at a pitch of approximately 0.4 mm, for example, in each of the side surfaces of protruding portion 13 and each of the bottom surfaces of recessed groove portions 12. Further, in each of the side surfaces of protruding portion 13 and the bottom surfaces of recessed groove portions 12, there are Ten (10) first terminals 61 to be accommodated in respective first terminal accommodating cavities 15 arranged at a pitch of, for example, approximately 0.4 mm. Further, in the inner side surfaces of side wall portions 14, each first terminal accommodating groove 16 is formed at positions which correspond to one first terminal accommodating cavity 15. Hence, first terminal accommodating cavities 15 and first terminal accommodating grooves 16 cooperatively function to accommodate first terminals 61. The pitch and number of first terminal accommodating cavities 15, first terminal accommodating grooves 16 and first terminals 61 may be changed as necessary.

Furthermore, at both ends of first housing 11 in the longitudinal direction thereof, end wall portions 26 extend in the lateral direction, and both ends thereof are connected to side wall portions 14. Inside the recessed portion, outer side portions of both ends of protruding portion 13, surrounded by end wall portions 26 and portions near both ends of side wall portions 14, act as insertion recessed portions 21. In other words, insertion recessed portions 21 are formed on the outer sides of both ends of recessed groove portions 12. Insertion recessed portions 21 are areas where insertion projecting portions 121 provided in second connector 101 are inserted in a state where first and second connectors 1, 101 are fitted to each other.

Each first terminal 61 is integrally formed, produced by stamping and bending a conductive metallic plate, and provided with held portion 63, tail portion 62 connected to a lower end of held portion 63, upper side connecting portion 67 connected to an upper end of held portion 63, second contact portion 66 formed in the proximity of an inner side end of upper side connecting portion 67, lower side connecting portion 64 connected to second contact portion 66, and first contact portion 65 formed near a free end of lower side connecting portion 64. Held portion 63 preferably extends in a vertical direction in the thickness direction of first housing 11, and is fitted into and held by each first terminal accommodating groove 16. Tail portion 62 is preferably connected to held portion 63 by bending relative thereto, extends outwardly in the lateral direction—in the width direction of first housing 11, and is connected to a connection pad coupled to a conductive trace on first board 91 by soldering and the like. Further, upper side connecting portion 67 is connected to held portion 63 by bending relative thereto, and extends inwardly in the width direction of first housing 11. In an inner side end of upper side connecting portion 67, curved second contact portion 66 is formed, bent downwardly and projected inwardly. Moreover, lower side connecting portion 64 is connected to a lower end of second contact portion 66 and has a "U"-shaped side surface. Further, in a free end of lower side connecting portion 64, i.e., in the vicinity of an upper end thereof on the inner side, curved first contact portion 65 is formed, which is bent into a "U"-shape and projected outwardly.

Each first terminal 61 is fitted into one first terminal accommodating cavity 15 and one first terminal accommodating groove 16 from a mounting surface side, and both sides of each held portion 63 are held by the side walls of one first terminal accommodating groove 16, thereby fixing each first terminal 61 to first housing 11. Thus, each first terminal 61 faces each side wall portion 14, which extends in parallel to both sides of protruding portion 13.

Figure 5:
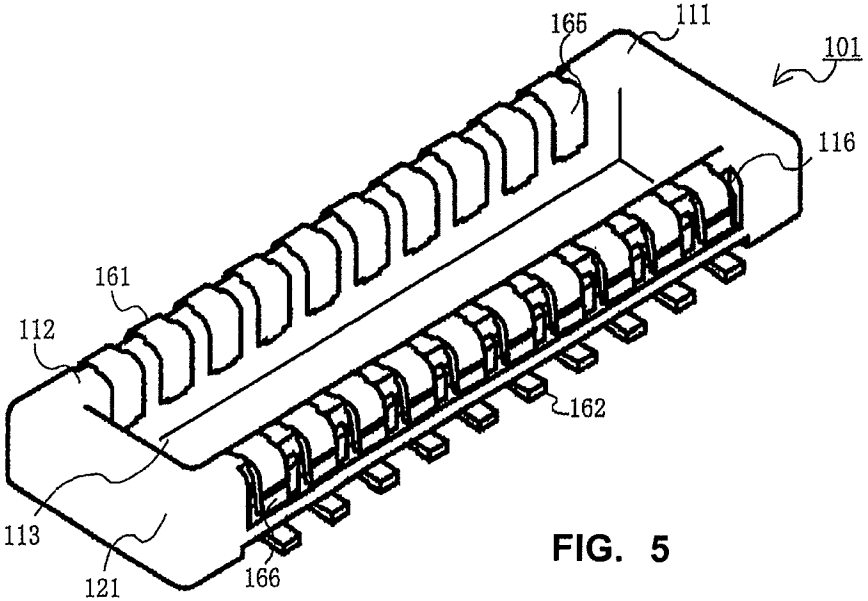
FIG. 5 is a perspective view of the second connector of FIG. 2, observed from a fitting surface side thereof.
Figure 6:
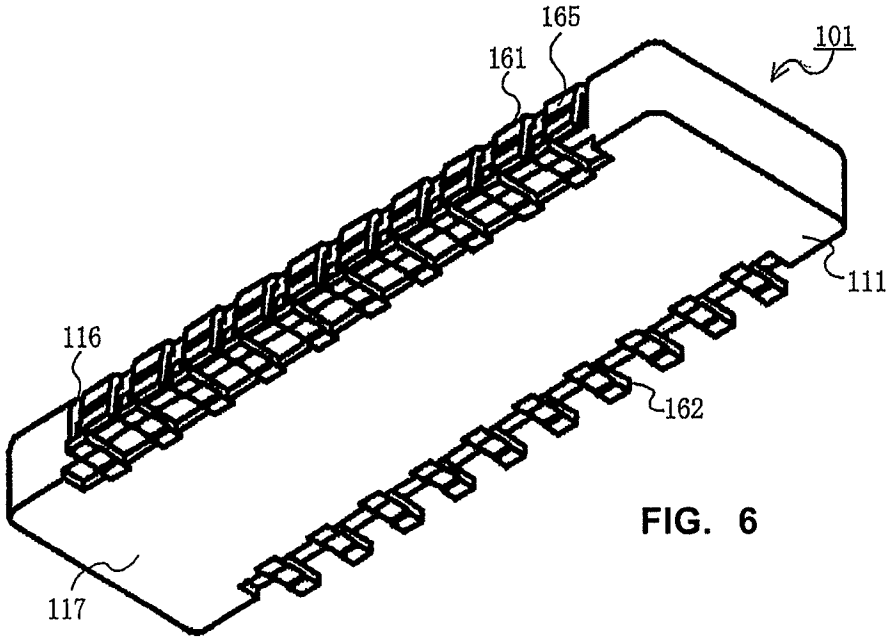
FIG. 6 is a perspective view of the second connector of FIG. 2, observed from a mounting surface thereof.
Figure 7:
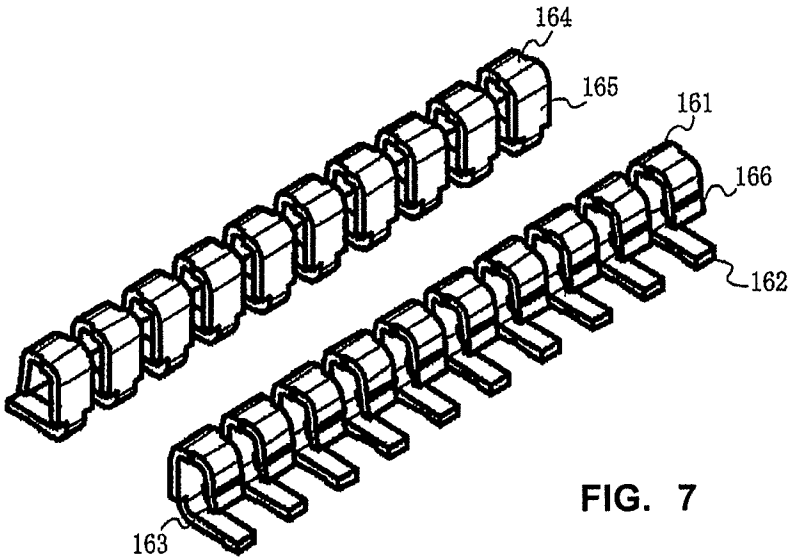
FIG. 7 is a perspective view of second terminals arranged according to the Present Invention, observed from the fitting surface side.

Referring to FIGS. 5-7, second connector 101 includes second housing 111 integrally formed of an insulating material. As illustrated, second housing 111 has an approximately rectangular, parallelepiped, thick plate-like shape. Second housing 111 has dimensions of, for example, approximately 6.0 mm in length, approximately 1.5 mm in width and approximately 0.8 mm in thickness, although these dimensions may vary.

Protruding portions 112, which extend in a longitudinal direction, are formed integrally with second housing 111 on a side surface thereof which is inserted into first connector 1. Protruding portions 112 are formed along both sides of second housing 111, respectively. Further, thin, long recessed groove portion 113, extending in the longitudinal direction of second housing 111, is formed between protruding portions 112 on both sides. As shown in FIG. 6, recessed groove portion 113 has a surface thereof on the side to be mounted on second board 191. That is, a mounting surface side thereof, which is closed by bottom plate portion 117. In the Figures, the number of protruding portions 112 is two; however, there may be any other number, as necessary. Recessed groove portion 113 has a dimension of, for example, approximately 0.7 mm in width, although this dimension may vary.

In the outer side surfaces of protruding portions 112, recessed groove-shaped second terminal accommodating grooves 116 are formed in order to accommodate second contact portions 166. There are, for example, Ten (10) second terminal accommodating grooves 116 formed at a pitch of approximately 0.4 mm in the outer side surfaces of each of protruding portions 112. Also, there are, for example, Ten (10) second terminals 161 of which second contact portions 166 are accommodated in second terminal accommodating grooves 116, and are arranged at a pitch of, for example, approximately 0.4 mm in the side surface and top portion of each of protruding portions 112. The pitch and number of second terminal accommodating groove 116 and second terminals 161 may be changed as necessary.

Further, at both ends of second housing 111 in the longitudinal direction thereof, insertion projecting portions 121 are provided, which extend in the lateral direction. Both ends of each insertion projecting portion 121 are connected to protruding portions 112. Insertion projecting portions 121 are inserted into insertion recessed portions 21 of first connector 1 in a state where first and second connectors 1, 101 are fitted together.

Each second terminal 161 is a member which is integrally formed and produced by stamping and bending a conductive metallic plate, and is provided with held portion 163, tail portion 162 connected to a lower end of held portion 163, first contact portion 165 connected to an upper end of held portion 163, connecting portion 164 connected to an upper end of first contact portion 165, and second contact portion 166 connected to an outer end of connecting portion 164. Held portion 163 is curved at almost Ninety Degrees (90°), and surrounded and held by second housing 111. Tail portion 162 is preferably connected to a lower end which extends in the lateral direction (the width direction of second housing 111) of held portion 163, extends outwardly from second housing 111 and is connected to a connection pad coupled to a conductive trace on second board 191 by soldering or the like. Further, first contact portion 165 is connected to an upper end of held portion 163 and extends upwardly along an inner side surface of each insertion projecting portion 121. Connecting portion 164 is connected to first contact portion 165 by bending relative thereto, extending outwardly in the width direction of second housing 111. Second contact portion 166 is connected to an outer end of connecting portion 164 by bending relative thereto in an obliquely downward direction, and is formed as a cantilever-like portion at a lower end thereof, a free end extending downwardly and outwardly.

Second terminals 161 are preferably integral with second housing 111. Thus, second housing 111 is formed by filling a mold cavity with resin, when second terminals 161 are preliminarily positioned in the mold. Therefore, second terminals 161 are integrally accommodated in second housing 111 when held portions 163 are embedded in second housing 111, and the rest of the portions are exposed around second housing 111. Thus, second terminals 161 are mounted to confront protruding portions 112 formed on the sides of second housing 111.

Figure 8:
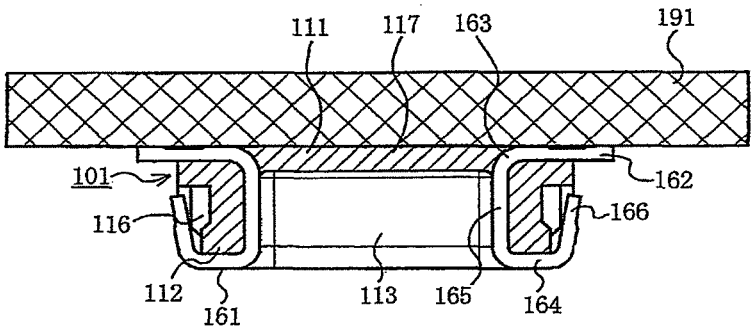
FIG. 8 is a cross-sectional view of the first and second connectors, showing a state before being fitted to each other.
Figure 8:
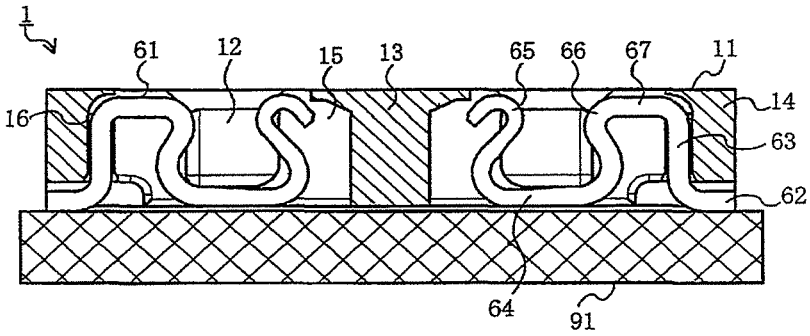
Figure 9:
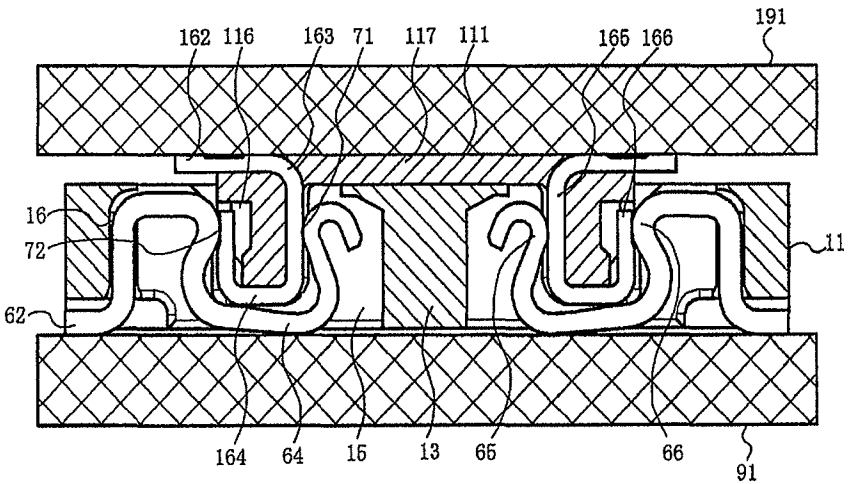
FIG. 9 is a cross-sectional view of the first and second connectors, showing a state after being fitted to each other.
Figure 10:
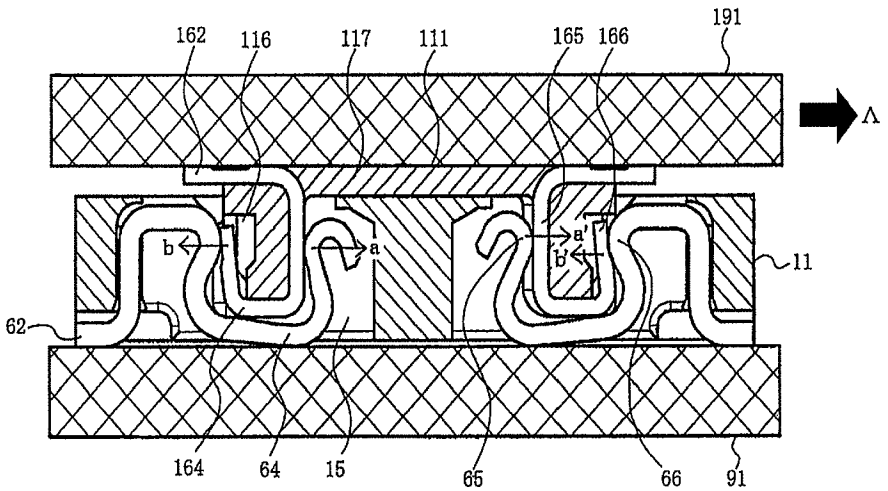
FIG. 10 is a cross-sectional view of the first and second connectors, a state where an external force is applied thereto while being fitted together.
Figure 11A:
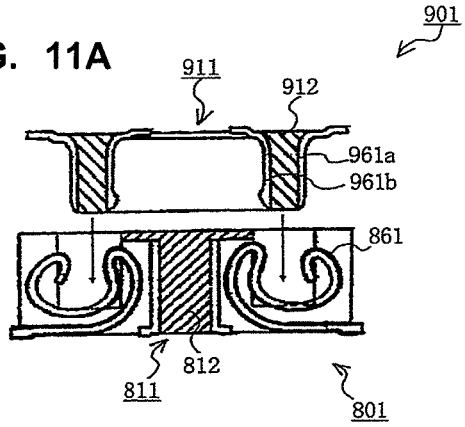
Figure 11B:
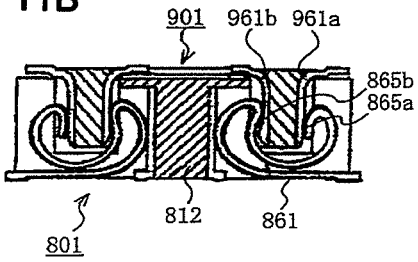

FIGS. 8-10 illustrate the operation for fitting first connector 1 and second connector 101. As illustrated, first connector 1 is mounted on a surface of first board 91, as tail portion 62 of each first terminal 61 is connected to a connection pad coupled to a conductive trace on first board 91 by soldering or the like. The distal end of tail portion 62 is located on the inner side of each side wall portion 14, which means that each tail portion 62 does not extend outwardly from the outer side surface of each side wall portion 14. Therefore, the dimension of first connector 1 in the width direction thereof can be reduced, and the width of the mounting surface, which is necessary for mounting first connector 1 onto first board 91, can be reduced as well.

As shown in FIG. 8, the distal end of each second contact portion 66 projects into each recessed groove portion 12 from each first terminal accommodating cavity 15 in each side wall portion 14, and the distal end of each first contact portion 65 projects into each recessed groove portion 12 from each first terminal accommodating cavity 15 in protruding portion 13. Therefore, as shown in FIG. 9, both sides of each second terminal 161 of second connector 101 inserted into recessed groove portions 12 can be sandwiched between first and second contact portions 65, 66. The locations of first and second contact portions 65, 66 are approximately the same in the thickness direction of first housing 11 and are facing each other.

Each second contact portion 66 is formed near the other end of upper side connecting portion 67, in which one end thereof is connected to held portion 63. In other words, each second contact portion 66 is connected to an upper end of held portion 63, fixedly secured to each side wall portion 14 of first housing 11 via short stick-shaped upper side connecting portion 67. Therefore, the length of a portion which functions as a spring between second contact portion 66 and held portion 63 is small, thereby giving each of second contact portions 66 high rigidity, low flexibility and resistance to displacement.

On the other hand, each first contact portion 65 is formed near the other end of "U"-shaped lower side connecting portion 64 in which one end thereof is connected to second contact portion 66. In other words, each first contact portion 65 is connected to second contact portion 66 having a certain level of flexibility via long and curved lower side connecting portion 64. Therefore, the length of a spring portion between first contact portion 65 and held portion 63 is large, thereby making each first contact portion 65 low in its rigidity, high in its flexibility and easy to be moved or displaced elastically. Further, each first terminal accommodating cavity 15 in protruding portion 13 is made into a size which is large enough to allow inward displacement of each first contact portion 65 into first housing 11. Similarly, second connector 101 is mounted on a surface of second board 191 as tail portion 162 of each second terminal 161 is connected to a connection pad coupled to a conductive trace on second board 191.

As shown in FIG. 8, each first contact portion 165 extends along the inner side wall of each protruding portion 112 and is exposed within recessed groove portion 113, and each second contact portion 166 projects outwardly from the outer side wall of each protruding portion 112. Therefore, as shown in FIG. 9, first and second contact portions 165, 166 of each second terminal 161 of second connector 101, which is inserted into recessed groove portions 12, are able to come into contact with first and second contact portions 65, 66 of each first terminal 61, which sandwich both sides of each second terminal 161.

In each contact portion 165, one end is connected to held portion 163 surrounded by second housing 111, with the outer side surface thereof being in tight contact with the inner side wall of each protruding portion 112, and the other end being connected to connecting portion 164, which is in tight contact with each protruding portion 112. Thus, since the entire body of each first contact portion 165 is virtually restrained by second housing 111, each first contact portion 165 has high rigidity, low flexibility and is resistant against elastic displacement.

On the other hand, in each second contact portion 166, while one end thereof is connected to first contact portion 165 via connecting portion 164, the other end thereof is a free end apart from the outer side wall of each protruding portion 112 and able to be displaced, and further, does not come into contact with the inner wall of each second terminal accommodating groove 116 of each protruding portion 112. Therefore, the entire body is not restrained at all. Further, each second contact portion 166 acts as a cantilever in which a distal end thereof is connected to connecting portion 164, and is low in rigidity, high in flexibility and easily elastically displaced. Moreover, each second terminal accommodating groove 116 is large enough to displace inwardly each second contact portion 166 into second housing 111.

As shown in FIG. 8, the fitting surfaces of first and second connectors 1, 101 face each other. In this case, the fitting surfaces are approximately in parallel with each other, and first and second boards 91, 191 are also approximately in parallel with each other.

Next, the connector 1 and/or second connector 101 are/is moved toward the counterpart connector, so that first and second connectors 1, 101 are fitted together, as shown in FIG. 9. In the state where first and second connectors 1, 101 are fitted together, protruding portions 112 of second housing 111 are inserted into recessed groove portions 12 of first housing 11. Further, first contact portion 65 of each first terminal 61 and first contact portion 165 of each second terminal 161 come into contact with each other, thus forming first contact point 71. Second contact portion 66 of each first terminal 61 and second contact portion 166 of each first terminal 161 come into contact with each other, thus forming second contact point 72.

Hence, an electrical conduction is established between respective first terminals 61 and respective second terminals 161 and as a result, the conductive trace coupled to the connection pad on first board 91, to which tail portion 62 of each first terminal 61 is connected, and the conductive trace coupled to the connection pad on second board 191, to which tail portion 162 of each second terminal 161 is connected, are electrically connected to each other.

In this case, first and second terminals 61, 161 come into mechanical and electrical contact with each other at first contact point 71 and the second contact point 72. In other words, first and second terminals 61, 161 are in multipoint contact with each other. Therefore, the electrical conduction state thereof is maintained. Further, at first contact point 71, first contact portion 65 of each first terminal 61 has a high flexibility, and first contact portion 165 of each second terminals 161 has a high rigidity. Furthermore, at second contact point 72, second contact portion 66 of each first terminal 61 has a high rigidity, and second contact portion 166 of each second terminal 161 has a high flexibility.

Therefore, even if a certain force active to unlock the fitted state of first and second connectors 1, 101, there is a difficulty in removing second connector 101 from first connector 1, as one of the terminals exhibits a high rigidity at either one of first and second contact points 71, 72. This means that a large removal force is required for disconnection of the fitted connectors.

On the other hand, when a force active to fit first and second connectors 1, 101 together, it is easy to insert protruding portions 112 of second connector 101 into recessed groove portions 12 of first connector 1, as a high flexibility is exhibited by one of the aforementioned terminals at first and second contact points 71, 72. This means that merely a small insertion force is necessary for connection of the connectors. Furthermore, even if an external force is applied in a state where first and second connectors 1, 101 are fitted to each other, the contact states at first and contact points 71, 72 are certainly maintained, and the electrical conduction state between each of first terminals 61 and each second terminal 161 are maintained without fail.

For example, consideration is directed to a case where an external force is applied so that second connector 101 is rightward displaced (in the direction of arrow A) relative to first connector 1, as shown in FIG. 10. First, attention is directed to the relationship between first and second terminals 61, 161 on the left side in FIG. 10. First contact portion 65, which has a high flexibility, is elastically displaced rightward (in the arrow a direction) at first contact point 71, thereby maintaining contact with first contact portion 165. Further, second contact portion 166, which has a high flexibility, is elastically displaced leftward (in the arrow b direction) at second contact point 72, thereby maintaining contact with second contact portion 66. Similarly, attention is directed to the relationship between first and second terminals 61, 161 on the right side in FIG. 10, first contact portion 65, which has a high flexibility, is elastically displaced rightward (in the arrow a' direction) at first contact point 71, thereby maintaining contact with first contact portion 165. Further, second contact portion 166, which has high a flexibility, is elastically displaced leftward (in the arrow b' direction) at second contact point 72, thereby maintaining contact with second contact portion 66 of first terminal 61.

Therefore, at first and second contact points 71, 72, an external force is absorbed and maintain the contact states as first and second contact portion 65, 166, which have high flexibility, are elastically displaced. Therefore, even if a large external force such as an impact is applied, at least one of first or second contact point 71, 72 is able to maintain the contact state thereof, thereby unfailingly maintaining a conduction state between each first terminal 61 and each second terminal 161. Therefore, non-conduction states at both first and second contact points 71, 72 caused by even instantaneous interruption of the contact states, in other words, instantaneous disconnection, does not occur.

Moreover, the natural frequency of first contact portion 65, elastically displaced at first contact point 71, and of second contact portion 166, elastically displaced at second contact point 72, are different from each other, as evident from the fact that the geometrical shapes thereof are different. Therefore, even when both first and second contact portions 65, 166 vibrate at the same time due to an impact applied thereto, the timing of disconnection of first contact portion 65 from first contact portion 165, and the timing of disconnection of second contact portion 166 from second contact portion 66 are not in synchronization with each other because both first and second contact portions 65, 166 of each second terminal 161 have different vibration frequencies. Therefore, a non-conduction state at both first and second contact portions 71, 72 does not simultaneously occur, preventing instantaneous disconnection.

Described herein is only the example where first and second contact portions 65, 166 are formed to have a high flexibility, and first and second contact portions 66, 165 are formed to have a high rigidity. However, first and second contact portions 65, 166 may be formed with a high rigidity, and first and second contact portions 66, 165 may be formed with a high flexibility.

As is understood, in the present embodiment, the board connector includes first connector 1, provided with first terminals 61, and first housing 11, capable of accommodating first terminals 61, and second connector 101, configured to be fitted to first connector 1 and to include second terminals 161 and second housing 111, capable of accommodating second terminals 161. First and second terminals 61, 161 are configured to come into contact with each other at first and second contact points 71, 72, respectively, each first terminal 61 capable of a high flexibility and each second terminal 161 capable of a high rigidity at either one of first or second contact point 71, 72. Further, each first terminal 61 is capable of a high rigidity and each second terminal 161 is capable of a high flexibility at different either one of first or second contact point 71, 72. Therefore, even when an external force is applied from the outside, contact states can be certainly maintained at the first and second contact points, thereby increasing liability in the performance of the board connector. Moreover, both small insertion force and large removal force are realized, thereby increasing operability.

Further, the natural frequency of first or second terminals 61, 161 having high flexibility at first contact point 71 is different from the natural frequency of first or second terminals 61, 161 having high flexibility at second contact point 72. Therefore, a non-conductive state does not simultaneously occur at first and second contact points 71, 72, thereby preventing instantaneous disconnection of the connector.

While a preferred embodiment of the Present Invention is shown and described, it is envisioned that those skilled in the art may devise various modifications without departing from the spirit and scope of the foregoing Description and the appended Claims.

What is claimed is:

1. A board connector comprising:

a first connector, the first connector including first terminals and a first housing capable of accommodating the first terminals, each first terminal including a first contact portion and a second contact portion connected by a connecting portion, the first contact portion shaped to project outward from at least one recessed groove portion formed in the first housing, the connecting portion being initially disposed in a position substantially parallel to a floor of the housing and a printed circuit board on which the first connector is mounted; and a second connector, the second connector being configured to mate with the first connector and including second terminals and a second housing capable of accommodating the second terminals, each second terminal including a first contact portion and a second contact portion;

wherein:

the first terminals and the second terminals contact each other at first contact points and second contact points, respectively; and each first terminal is capable of showing a high flexibility and each second terminal is capable of showing a high rigidity at either one of the first contact point and the second contact point, and each first terminal is capable of showing a high rigidity and each second terminal is capable of showing a high flexibility at the other one of the first contact point and the second contact point; and upon contact of the first terminal and the second terminal, the connecting portion is displaced from its position substantially parallel to the floor of the housing to a position angled toward the printed circuit board.

2. The board connector of claim 1, wherein the terminals showing the high flexibility at the first contact points have a natural frequency thereof, different from the terminals showing the high flexibility at the second contact points.

3. The board connector of claim 2, wherein each first terminal first contact portion has a high flexibility and each first terminal second contact portion has a high rigidity.

4. The board connector of claim 3, wherein each second terminal first contact portion has a high rigidity and each second terminal second contact potion has a high flexibility.

5. The board connector of claim 4, wherein the first contact portions of each first terminal and each second terminal come into contact with each other at the first contact point.

6. The board connector of claim 5, wherein the second contact portions of each first terminal and each second terminal come into contact with each other at the second contact point.

7. The board connector of claim 6, wherein each first terminal further includes a held portion thereof held by the first housing, the second contact portion being connected to the held portion and having a distal end thereof projecting into each recessed groove portion of the first housing, and the first contact portion being connected to the second contact portion via a U-shaped connecting portion and having a distal end thereof projecting into each recessed groove portion of the first housing while facing the second contact portion.

8. The board connector of claim 7, wherein each second terminal further includes a held portion thereof held by the second housing, the first contact portion being connected to the held portion and in contact with one of side walls of each protruding portion of the second housing, the second contact portion having a cantilever-shape and one end thereof connected to the first contact portion and the other end thereof distant apart from the other side wall of each protruding portion.

9. The board connector of claim 8, wherein each second terminal comes to a position where each second terminal is sandwiched between the first contact portion and the second contact portion of each first terminal when the protruding portions are inserted into the recessed groove portions.

10. The board connector of claim 4, wherein the second contact portions of each first terminal and each second terminal come into contact with each other at the second contact point.

11. The board connector of claim 10, wherein each first terminal further includes a held portion thereof held by the first housing, the second contact portion being connected to the held portion and having a distal end thereof projecting into each recessed groove portion of the first housing, and the first contact portion being connected to the second contact portion via a U-shaped connecting portion and having a distal end thereof projecting into each recessed groove portion of the first housing while facing the second contact portion.

12. The board connector of claim 11, wherein the first contact portions of each first terminal and each second terminal come into contact with each other at the first contact point.

13. The board connector of claim 11, wherein each second terminal further includes a held portion thereof held by the second housing, the first contact portion being connected to the held portion and in contact with one of side walls of each protruding portion of the second housing, the second contact portion having a cantilever-shape and one end thereof connected to the first contact portion and the other end thereof distant apart from the other side wall of each protruding portion.

14. The board connector of claim 13, wherein each second terminal comes to a position where each second terminal is sandwiched between the first contact portion and the second contact portion of each first terminal when the protruding portions are inserted into the recessed groove portions.

15. The board connector of claim 1, wherein each first terminal first contact portion has a high flexibility and each first terminal second contact portion has a high rigidity.

16. The board connector of claim 15, wherein each second terminal is provided with a first contact portion having the high rigidity and a second contact potion having the high flexibility.

* * * * *